US006625917B2

(12) United States Patent
Murello et al.

(10) Patent No.: US 6,625,917 B2
(45) Date of Patent: Sep. 30, 2003

(54) BOLT ASSEMBLY FOR A FIREARM

(75) Inventors: Johannes Murello, Deisslingen (DE); Helmut Weldle, Oberndorf (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 09/911,008

(22) Filed: Jul. 23, 2001

(65) Prior Publication Data

US 2002/0026739 A1 Mar. 7, 2002

Related U.S. Application Data

(63) Continuation of application No. PCT/EP00/00551, filed on Jan. 25, 2000.

(30) Foreign Application Priority Data

Jan. 28, 1999 (DE) ..... 199 03 327

(51) Int. Cl.[7] ..... F41A 3/00; F41C 7/00

(52) U.S. Cl. ..... 42/16; 42/25

(58) Field of Search ..... 42/16, 25

(56) References Cited

U.S. PATENT DOCUMENTS

| | | | | |
|---|---|---|---|---|
| 2,481,548 A | | 9/1949 | Waltke | 89/162 |
| 2,967,367 A | | 1/1961 | Ivy | 42/16 |
| 3,341,963 A | * | 9/1967 | Seiderman | 42/16 |
| 3,791,060 A | * | 2/1974 | Weaver | 42/16 |
| 3,791,256 A | * | 2/1974 | Curtis et al. | 89/185 |
| 3,807,075 A | | 4/1974 | Mylonas | 42/98 |
| 3,882,625 A | | 5/1975 | Iellie | 42/25 |
| 3,906,651 A | | 9/1975 | Vesamaa | 42/25 |
| 3,969,983 A | | 7/1976 | Zellweger | 89/185 |
| 3,999,318 A | | 12/1976 | Tellie | 42/106 |

(List continued on next page.)

FOREIGN PATENT DOCUMENTS

| | | |
|---|---|---|
| CH | 580 269 | 9/1976 |
| DE | 501266 C | 7/1930 |
| DE | 1858576 | 9/1962 |
| DE | 2 402 445 | 8/1974 |
| DE | 24 43 044 | 9/1974 |
| DE | 28 12 732 | 6/1979 |
| DE | 32 44 315 A1 | 5/1984 |
| FR | 2.215.600 | 1/1973 |

OTHER PUBLICATIONS

International Preliminary Examination Report for PCT/EP00/00644 dated Apr. 27, 2001.

International Search Report for PCT/EP00/00520 dated May 26, 2000.

International Preliminary Examination Report for PCT/EP00/00520 dated Aug. 13, 2001.

*International Search Report* corresponding to International Patent Applicaton Serial No. PCT/EP00/00551, dated May 19, 2000, 4 pages.

*International Preliminary Examination Report* corresponding to International Patent Application Serial No. PCT/EP00/00551, dated Aug. 13, 2001, 5 pages.

*International Serach Report* corresponding to International Patent Application Serial. No. PCT/EP00/00644, European Patent Office, Dated May 19, 2000, 4 pages.

*Primary Examiner*—Michael J. Carone
*Assistant Examiner*—M. Thomson
(74) *Attorney, Agent, or Firm*—Grossman & Flight, LLC

(57) ABSTRACT

A bolt assembly for use in a firearm is disclosed which is movably arranged in a weapon housing and which includes a bolt carrier and a bolt head. The bolt head can be alternately inserted in at least two positions in the weapon housing to adapt the firearm to eject spent cartridge casings in a desired direction. The bolt assembly also includes an extractor which is fastened laterally on the bolt or bolt head for withdrawing a cartridge casing from a barrel of the weapon housing during return of the bolt assembly, and an ejector integrated in the bolt mechanism which removes the cartridge casing from the bolt assembly after extraction from the barrel.

5 Claims, 2 Drawing Sheets

U.S. PATENT DOCUMENTS

| | | | | | |
|---|---|---|---|---|---|
| 4,020,577 | A | * | 5/1977 | Duffy | 42/16 |
| 4,191,089 | A | | 3/1980 | Zedrosser | 89/181 |
| 4,272,902 | A | * | 6/1981 | Waters | 42/25 |
| 4,328,737 | A | | 5/1982 | Nelson et al. | 89/33 |
| 4,481,858 | A | | 11/1984 | Price | 89/11 |
| 4,562,659 | A | * | 1/1986 | Neta | 42/75 |
| 4,563,937 | A | | 1/1986 | White | 89/185 |
| 4,635,530 | A | | 1/1987 | Weldle | 89/159 |
| 4,644,930 | A | * | 2/1987 | Mainhardt | 124/58 |
| 4,676,017 | A | * | 6/1987 | Hurlemann et al. | 42/25 |
| 4,691,615 | A | | 9/1987 | Brunton | 89/33.4 |
| 5,285,593 | A | | 2/1994 | Bammate | 89/33.4 |
| 5,499,569 | A | | 3/1996 | Schuetz | 89/197 |
| 5,821,445 | A | * | 10/1998 | Guhring | 89/1.42 |
| 6,000,161 | A | | 12/1999 | Aalto | 42/16 |
| 6,044,748 | A | | 4/2000 | Westrom | 89/185 |
| 6,101,919 | A | | 8/2000 | Murello | 89/188 |
| 6,314,672 | B2 | * | 11/2001 | Murello et al. | 42/75.02 |

* cited by examiner

BOLT ASSEMBLY FOR A FIREARM

RELATED APPLICATION

This patent is a continuation and claims priority under 35 U.S.C. §120 from International Application No. PCT/EP00/00551, which was filed on Jan. 25, 2000.

FIELD OF THE INVENTION

The invention relates generally to firearms, and, more particularly, to firearms including a bolt assembly which can be configured to eject spent cartridges in a desired direction suitable for the shooter of the firearm.

BACKGROUND OF THE INVENTION

The position terms used in this patent, like "front", "back", "top", "bottom" or the like always assume a weapon in the normal firing position; (i.e., a weapon position in which the center axis of the barrel of the weapon runs generally horizontally and the direction of firing points "forward" away from the shooter). The same convention applies for the direction statements used herein ("to the front", "upward", "leftward", etc.).

Bolt assemblies for incorporation into a small arm are known. One such assembly is known from FR-A-2,215,600. Bolt assemblies are also known in which the bolt head has a radial pin that engages in a slider that serves as a curved guide (see, for example, DE-A-32 44 315 D2).

A similar bolt assembly is also known from CH-A-580 269. After shooting, the bolt assembly travels rearward and a claw-like extractor on the bolt surface extracts the empty cartridge casing from the barrel. Casing ejection is then produced by the ejector, which strikes against the cartridge casing bottom during return of the bolt assembly. The cartridge is tilted laterally by the extractor and ejected through an opening in the weapon housing. The position of the bolt assembly can be varied for right or left ejection.

In simply configured automatic weapons, for example, in the Soviet assault rifle AK-47 (Kalaschnikov), casing ejection is produced through a protrusion fixed on the housing. The bottom of the cartridge casing strikes against this protrusion during return of the bolt assembly.

The ejection process just described can also be produced manually by the shooter. This is necessary, for example, when a cartridge does not fire during the shooting process and is not automatically ejected. The shooter must then reload by hand, whereupon the still live cartridge is ejected. The term cartridge casing, as used herein, therefore does not refer merely to the spent casings, but also to the casings of live cartridges.

Present day semiautomatic weapons and submachine guns are generally designed only for right-hand use. In these weapons the casings, during firing, are ejected on the right side. A left-hand shooter, who fires the weapon from the left shoulder, therefore faces the hazard of being struck on the right arm by the ejected cartridge casings. This hazard represents a significant burden for the shooter and makes left-handed use of such a weapon problematical.

In small arms of the so-called bullpup design, the magazine and bolt assembly are positioned behind (instead of in front of) the trigger. The casing ejector arranged above the magazine is, therefore, situated next to or right in front of the face when the weapon is aimed. Ejected casings in a right-handed weapon would therefore fly directly against the head or into the face of a left-handed shooter. Therefore, firing with the left hand is extremely hazardous, if not impossible, in a bullpup-type weapon that ejects to the right since the shooter cannot properly aim the weapon, but, instead, is forced to keep the weapon forward, away from the body.

The problems just described make it clear why left-handed shooters in military service are forced to learn to use the right hand and right-handed weapons. Because of the desired standardization of equipment, no other weapons are often available. Weapons for left-handed use, however, can significantly improve security of firing and safe handling of the weapon among left-handed shooters.

Weapons have already long been known that have a casing ejector arranged in the center, so that the casings are ejected upward. An example of this is the US M1 Garand semiautomatic rifle. This type of cartridge ejector permits firing of the weapon from both shoulders. However, a shortcoming in this arrangement is that the shooter can easily be struck on the head by the ejected cartridges (for example, when shooting "from the hip", or when individual casings are ejected incorrectly (i.e., obliquely to the rear)). For weapons of the bullpup design, a center cartridge ejector is unsuitable, since the casings, as described above, are ejected at the site at which the shooter positions his head against the weapon for aiming.

Small arms are also known that permit conversion from right to left ejection and vice versa. For example, the French assault rifle FAMAS, is a bullpup design weapon in which the extractor claw can be alternately mounted on either of two sites on the bolt surface, so that the empty casings are ejected to the right or to the left. The weapon housing has ejection shafts on both sides. The ejection shaft which is not being used is covered by a cheek protector. Another example of this approach is the Austrian bullpup rifle Steyr AUG, in which, as in the FAMAS, the extraction claw can be mounted on either side.

In the bolt mechanism mentioned in CH 580 269 A5, a conversion between right and left ejection is produced by switching the bolt head from one incorporation position to another.

In addition, another bolt assembly is known from DE-GM 18 58 576, in which an ejector is accommodated, in addition to an extractor.

Moreover, a bolt assembly constructed from a bolt carrier and bolt head is known from DE 28 12 732 B2, in which the bolt head has a radial pin that engages in a slot of the bolt carrier that serves as a slot guide.

SUMMARY OF THE INVENTION

In accordance with an aspect of the invention, a firearm is provided which is capable of selectively ejecting a spent cartridge in either a first direction or a second direction. The firearm comprises a bolt carrier defining a first hole and a second hole; a bolt head dimensioned to be at least partially received within the bolt carrier; and a pin sized to engage the bolt housing and the first hole to secure the bolt head in a first position relative to the bolt carrier and to engage the bolt housing and the second hole to secure the bolt head in a second position relative to the bolt carrier. The firearm is adapted to eject the spent cartridge in the first direction when the bolt carrier is in the first position and to eject the spent cartridge in the second direction when the bolt carrier is in the second position.

BRIEF DESCRIPTION OF THE DRAWINGS

Identical reference numbers refer to the same elements throughout the figures.

DESCRIPTION OF THE PREFERRED EMBODIMENTS

Figure 1:
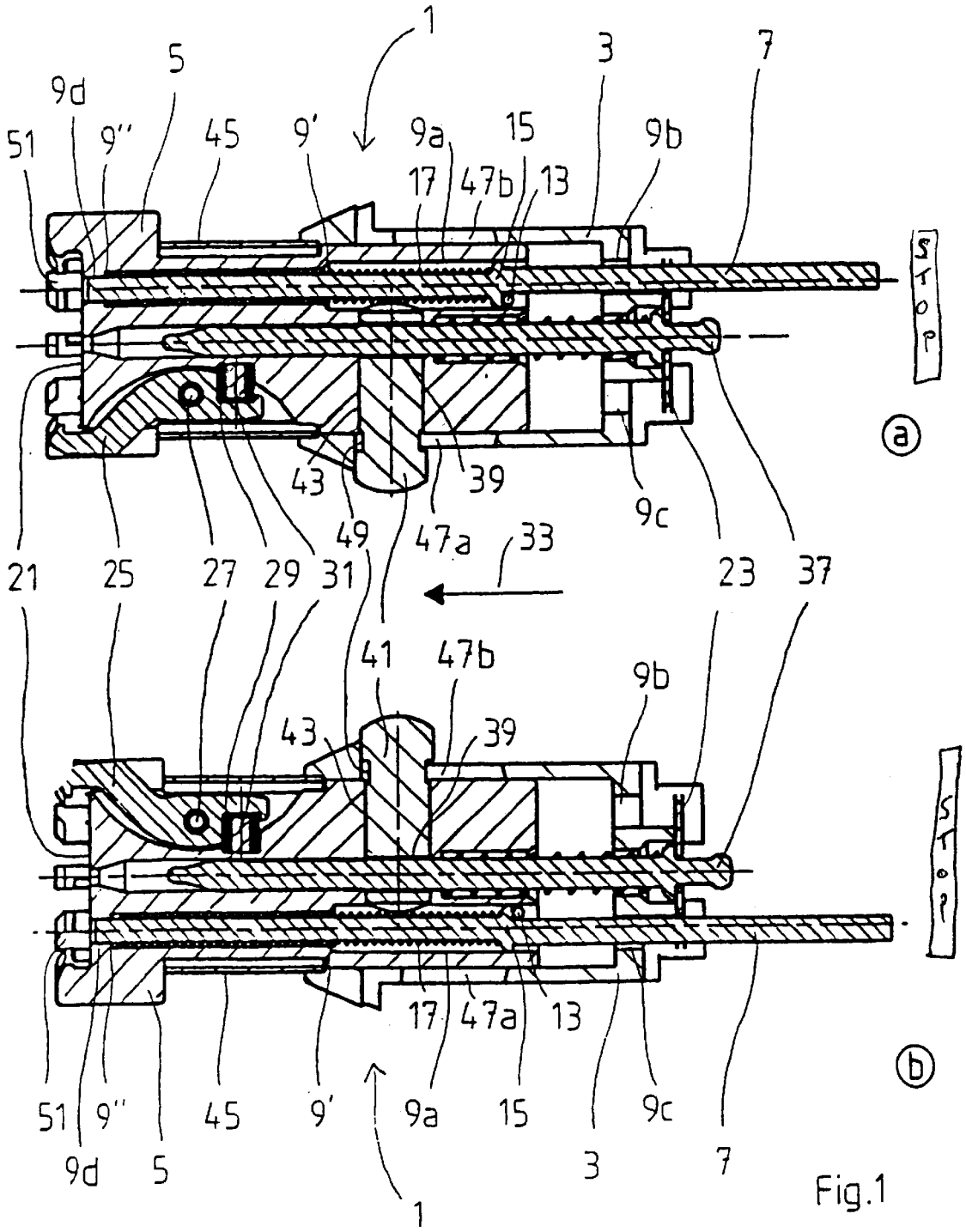
FIG. 1*a* is a sectional view of the top of an exemplary bolt assembly constructed in accordance with the teachings of this invention and having a bolt head in a first position.
FIG. 1*b* is a sectional of the top of the bolt assembly of FIG. 1*a* having the bolt head in a second position.

FIGS. 1*a* and 1*b* each show a bolt assembly 1 assembled from a bolt carrier 3 and a bolt head 5. The bolt carrier 3 includes at least two elongated holes 47*a*, 47*b* which serve as slot or slider guides. The bolt head 5 has a pin 41 that engages in a specific elongated hole 47*a*, 47*b*, depending on the selected position of the bolt head 5. In a preferred embodiment, the bolt head 5 may be secured into either of two different positions. One such position accommodates users shooting with their left hand, and the other position accommodates users shooting with their right hand.

In a preferred embodiment, the bolt carrier 3 is a can-like hollow element, into which the bolt head 5 can be introduced. Conversion of the bolt head 5 is then possible in particularly simple fashion. In a preferred embodiment, the bolt carrier 3 and bolt head 5 are designed so that the bolt head 5 can be rotated within the bolt carrier 3 around the center axis which runs in the longitudinal direction of the weapon. The position of the bolt head 5 is freely selectable on this account.

The assembly position of the bolt head 5 is stipulated by the pin 41. To this end, bolt head preferably has a transverse hole 43, into which the pin 41 can be introduced. The pin 41 preferably has a retaining hole 39, through which a firing pin 37 is guided. The firing pin 37 passes through pin 41 and through the bolt assembly 1 or bolt head 5 in the longitudinal direction of the weapon. During assembly, the pin 41 is first inserted into the transverse hole 43. The firing pin 37 is then guided through the retaining hole 39. The pin 41 is, therefore, held in its position by the firing pin 37. As an alternative, it is also possible to secure the pin 41 by an ejector 7. Under this approach, the ejector 7 passes through the pin 41 (instead of the firing pin 37).

It is possible with the above arrangement to initially introduce the bolt head 5 into the bolt carrier 3, and then introduce the pin 41 from the outside through an opening of the bolt carrier 3 into the transverse hole 39. Because of this possibility, the bolt head 5 can be simply anchored in the bolt carrier 3. A corresponding additional number of elongated holes 47*a*, 47*b* can be provided on the bolt carrier 3 if more than two assembly positions of the bolt head 5 are desired. In a preferred embodiment, however, the bolt carrier 3 has two diametrically opposite elongated holes or slots 47*a*, 47*b*.

Additionally, although the preferred examples described herein include one pin 41 with one or two slots, the bolt assembly can alternatively be designed so that two or more pins (in combination with a corresponding number of slots) simultaneously secure the position of the bolt head or guide its movement. The pins can have the same or different diameters.

As shown in FIGS. 1*a* and 1*b*, a striker-like ejector 7 is mounted to move in the through holes 9*a* and 9*d*. The rear end of the ejector 7 passes through the recess 9*b* or 9*c*. Movement of the ejector 7 is limited in the forward direction by a shoulder-like constriction 9' of through hole 9*a* and in a rearward direction by a cylindrical pin 13. The ejector 7 has a stop edge 15, with which it hangs up on the constriction 9' and the cylindrical pin 13.

A spring 17 is supported on the ejector 7 with its front end disposed against a shoulder 9" (between the through holes 9*a* and 9*d*). The rear end of the stop edge 15 of the ejector 7 presses against the cylindrical pin 13. In this manner, the ejector 7 is held in its initial position, in which its front end lies behind a percussion base 21 and its rear end protrudes rearward over bolt carrier 3. The ejector 7 is cylindrical and has a flattening on its outer surface behind stop edge 15. (See also FIG. 3). In this manner, the stop edge 15 covers the cylindrical pin 13 in space-saving fashion.

FIGS. 1*a* and 1*b* also illustrate an extractor claw 25. (Throughout this patent the terms "extractor 25" and "extractor claw 25" are used interchangeably.) The extractor claw 25 is located opposite the ejector 7 and fastened to pivot on bolt head 5 via a bearing 27. A spring 29 presses the front end of extractor claw 25 against bolt head 5. In a preferred embodiment, the spring 29 sits on a pin 31 that additionally increases the spring force and is made of plastic. Alternate embodiments of the spring 29 may, of course, be made of a different material.

The bolt head 5 is secured in its corresponding assembly position by the pin 41. After simply loosening the pin 41 from its engagement in the elongated hole 47*a* or 47*b*, the bolt head 5 can then be switched from one assembly position to the other (e.g., from the position of FIG. 1*a* to the position of FIG. 1*b* or vice versa). Because of the integration of the extractor 25 and the ejector 7 in the bolt head 5, the direction of casing ejection is also changed when the bolt head 5 is rotated between its assembly positions. Additional working steps are not required, since the extractor 25 and the ejector 7 remain on the bolt assembly 1 or bolt head 5 in their mutual relative position and their locations are changed with movement of the bolt head 5. Casing ejection in combat, therefore, cannot be converted from right to left "on the fly." However, the conversion time is significantly shortened. In addition, no replacement parts are required, but naturally can be additionally provided.

Figure 2:
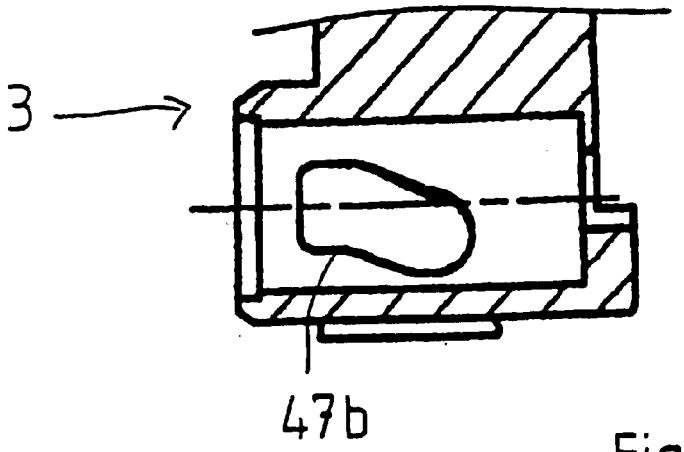
FIG. 2 is a side view of a bolt carrier of the bolt assembly shown in FIGS. 1*a* and 1*b*.

The pin 41 is removably disposed in the corresponding elongated hole 47*a* or 47*b* so that it can follow the curve of the elongated hole 47*a* or 47*b* when the bolt carrier 3 and bolt head 5 are pushed against each other. As shown in FIG. 2, the elongated hole 47*b*, like elongated hole 47*a* (hereafter also called a slot), is preferably arc-shaped and, with particular preference, is constructed so that the bolt head 5 (which is guided over the pin 41 during forward and return movement of the bolt assembly 1 or the bolt carrier 3) is initially rotated in the peripheral direction, and only then does bolt movement follow. This rotation of the bolt head 5 serves for locking and unlocking of the bolt assembly 1.

During forward movement of the bolt assembly 1 as a part of the loading process, a new cartridge is fed from a magazine and pushed by the bolt head 5 into the cartridge chamber (i.e., the part of the barrel that accommodates the cartridge). The bolt head 5 then lies on the cartridge chamber or bottom of the cartridge and stops while the bolt assembly 1 or bolt carrier 3 travels forward a bit further. In this manner the bolt assembly 1 and bolt head 5 are pushed against each other. The pin 41 then travels from front to rear within the arc-shaped elongated hole 47*a* or 47*b*. The pin 41 is then pushed in the peripheral direction of the bolt assembly so that the bolt head 5 is correspondingly rotated. Because of this rotation, the bolt assembly 1 locks (i.e., rearward movement of the bolt head 5 is blocked). This locking is caused, for example, by the fact that locking pegs 51 on the bolt head 5 engage with a matching slots or pegs on the cartridge chamber by rotation. After firing of the cartridge, the bolt carrier 3 travels back. This rearward movement rotates the bolt head 5 in the described manner in the peripheral direction, but this time in the opposite direction, so that the bolt assembly 1 is unlocked again. Finally, the pin 41 reaches the front end of the slot and is carried along rearward by the bolt carrier 3 (and with it, the bolt head 5). The time-delayed opening of the cartridge chamber guarantees that the bolt assembly 1 remains closed until the shot has left the barrel and the gas pressure has diminished.

Also during the loading process, the bolt assembly 1 is moved forward as indicated by arrow 33. The bottom of a cartridge (not shown here) is then forced against the percussion base 21. The extractor 25 is positioned laterally on the bolt surface (the so-called "percussion base" 21) and secures the cartridge or cartridge casing generally only on one side. The front end of the extractor 25 is preferably claw-like in structure, so that the edge of the casing bottom is grasped by the extractor claw 25 from beneath. The extractor claw 25 is sloped at its tip so that it initially is forced to the side when the edge of the cartridge bottom passes by. The extractor claw 25 then "snaps" in (i.e., engages behind the cartridge edge) in response to the pressure of spring 29. The cartridge is, therefore, held by the extractor claw 25 as soon as the cartridge bottom lies against percussion base 21.

One advantage of the preferred embodiment of this disclosed apparatus is associated with the dust flaps for the bolt assembly 1. For the two positions of the bolt head 5, the dust flaps are placed on the two ejection openings (a small arm with a convertible casing ejection generally has two ejection openings), which are opened by the bolt assembly 1 or bolt head 5 for casing ejection. This opening is effected by a protrusion on the bolt head 5 that strikes against a tab on the dust flap during return of the bolt assembly 1 and, in so doing, flips it open. In this case, the protrusion can be structured so that, depending on the position in which the bolt head 5 is incorporated, the "correct" dust flap is opened (i.e., the dust flap that lies in the direction of casing ejection). This type of arrangement is described in another U.S. application of the applicant entitled "Arrangement For Opening The Dust Flaps Of A Firearm" (Attorney Docket Number 29089/37461) and PCT/EP00/00520 which are hereby incorporated by reference in their entirety.

As an alternative to conversion of the bolt head 5, it is also conceivable to convert casing ejection by replacing the bolt head 5. In this case, a bolt head 5 is accordingly made available for right ejection and one for left ejection.

After firing (or during manual reloading), the bolt head 5 is moved rearward. The extractor claw 25 carries the cartridge casing with it and, thus, extracts it from the barrel. The rear end of the ejector 7 then encounters a stop in the weapon housing (shown schematically in FIGS. 1*a* and 1*b*). The ejector 7 then stops, while the bolt head 5 continues to move rearward. Because of this relative movement, the front end of ejector 7 protrudes from the through hole 9*d*, strikes against the cartridge bottom, tilts the cartridge casing laterally to release it from the grip of the extractor claw 25 and spins the cartridge laterally out of the weapon housing. In order for the ejector 7 to be able to easily "tilt out" the casing from the one-sided clamping by the extractor claw 25 and thus eject the casing laterally, it is advantageous if the contact point of the ejector 7 is located, if possible, on the side opposite the holding point of the extractor 25 and the center of gravity of the cartridge casing. On the other hand, if these points lie on the same side, there is a hazard that the cartridge casing will be pushed more strongly forward (and less to the side) by the kinetic energy of the ejector 7 from the grip of the extractor claw 25. The casing could then easily hang up in the weapon housing and cause jamming. Thus, the ejector 7 is preferably arranged on the percussion base 21 at a location diametrically opposite the extractor 25 so that the center of a cartridge lying against the percussion base 21 lies on an imaginary line between the extractor 25 and the ejector 7. This also explains why it is advantageous for conversion of casing ejection to also convert the ejector 7, in addition to the extractor 25.

In a preferred embodiment, the ejector 7 is designed as a striker which passes through the bolt assembly 1 or bolt head 5 in the longitudinal direction. Because the ejector 7 serves as a striker, the terms ejector and striker may be used interchangeably. When the bolt assembly 1 is locked, the striker 7 is arranged so that the front end of the striker 7 is lowered into the bolt assembly 1 or bolt head 5 (i.e., it is situated behind the percussion base 21), whereas its rear end preferably protrudes above the bolt assembly 1 or bolt head 5 rearward. During return of the bolt assembly 1 or bolt head 5, the rear end of the striker 7 comes into contact with a stop fixed to the housing so that the striker 7 stops. However, the bolt assembly 1 travels farther back so that the front end of the striker 7 emerges forward from the bolt assembly 1 or bolt head 5 and strikes against the bottom of a cartridge casing situated in the bolt assembly 1 or bolt head 5. The cartridge casing is ejected by this striking engagement in the manner described above.

The rear end of the striker 7 protrudes preferably rearward above the bolt assembly 1 or bolt head 5 during return of the bolt assembly 1, as described above. Because of this, the stop can be arranged behind the region exposed to the bolt movement. In this case, a simple shoulder 9" in the weapon housing or the front end of the shoulder support can serve as the stop. On the other hand, if the striker 7 does not protrude rearward, the stop must be designed so that, during return of the bolt assembly 1, it passes through the bolt assembly 1 or the bolt head 5.

After casing ejection, the bolt assembly 1 again travels forward and reloads a new cartridge. In principle, it is possible to allow the striker 7 to protrude forward above the percussion base 21 until the front end of the striker 7 encounters the cartridge being loaded and is pushed back to its initial position by this engagement. However, it is much more advantageous and will minimize possible disorders during reloading if the front end of the striker 7 is retracted before the bolt assembly 1 or bolt head 5. The striker 7 is, therefore, preferably loaded rearward by a spring 17, by which it is reliably pushed back into the bolt assembly 1 or bolt head 5 as soon as the bolt assembly 1 travels forward. Rearward movement of the striker 7 is limited by a stop, so that the striker 7 is moved rearward by the force of the spring 17 no farther than its initial position and remains there.

FIGS. 1*a* and 1*b* illustrate two different assembly positions that result in casings being ejected to the left and to the right. The extractor claw 25 and ejector 7 are arranged in FIG. 1*a* so that the cartridge casing is ejected to the left (downward in the drawing). In FIG. 1*b*, casing ejection occurs in the other direction or is ejected right (upward in the drawing). Conversion of the extractor claw 25 and the ejector 7 from the position in FIG. 1*a* to that of FIG. 1*b* and vice versa occurs by converting the bolt head 5. For this purpose, the safety plate 23 is initially removed so that the firing pin 37 can be pulled from a retaining hole 39 of a pin 41. The pin 41 is then pulled from a transverse hole 43 accommodating it. The bolt head 5, together with the ejector 7 and extraction claw 25, is now taken from the bolt carrier 3 and reinserted into the bolt carrier 3 in the opposite assembly position. The pin 41 is then pushed back into transverse hole 43 and secured by firing pin 37. The safety plate 23 is finally remounted.

FIG. 2 shows the bolt carrier 3 from the side without the bolt head 5. On its top, the bolt carrier 3 is connected to an extension (not shown here), through which the bolt carrier 3 can be moved in the longitudinal direction of the weapon. Slots 47*a* and 47*b* are situated on opposite sides of the bolt carrier 3. Although slot 47*a* is not depicted in FIG. 2, slot 47*a* is similarly shaped to slot 47*b* which is depicted in FIG. 2. Depending on whether casing ejection is set up for the left or right, the pin 41 protrudes from the left or right side of the bolt carrier and passes through the slot 47*a* or 47*b*. The pin 41 has a die-sinking 49, into which the edge of the slot 47*a* or 47*b* engages. The die-sinking 49 serves to lengthen the locking path, but is not absolutely necessary.

When the weapon is ready to fire, the bolt assembly 1 is locked (i.e., the locking pegs 51 of the bolt head 5 engage behind a matching counterpiece which is rigidly connected to the cartridge chamber). The pin 41 is then situated on the rear end of slot 47*a* or 47*b*. After firing, the bolt carrier 3 initially moves rearward. Because of the arc-like curve of slots 47*a*, 47*b*, the bolt head 5 is rotated via pin 41 so that the bolt assembly 1 is unlocked again: The pin 41 finally reaches the front end of slot 47*a*, 47*b* (positioned as shown in FIG. 1) and the bolt head 5 is carried rearward with the bolt carrier 3. A sleeve 45 prevents the bolt carrier 3 and bolt head 5 from displacement relative to each other and unintentional rotation of the bolt head 5 on this account during forward and return movement. For locking the bolt assembly 1, the sleeve 45 is compressed so that the bolt head 5 can be rotated again by the slot guide.

Figure 3:
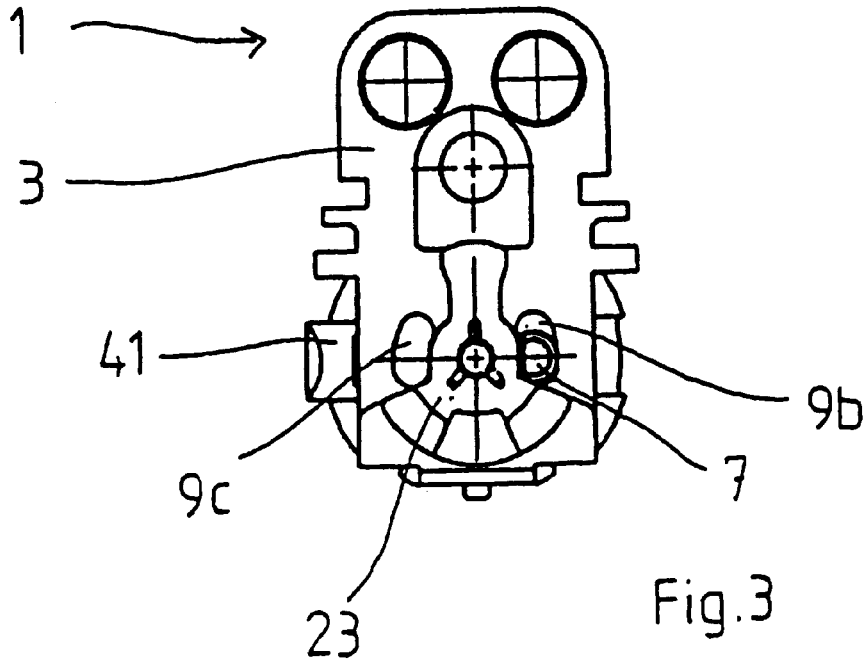
FIG. 3 is a rear view of the bolt assembly shown in FIG. 1*a*.

As shown in FIG. 3, the recesses 9*b* and 9*c* are lengthened in the peripheral direction so that the ejector 7 can follow the peripheral rotation of the bolt head 5 during locking and unlocking of the bolt assembly. In this manner, it is ensured that the rotational movement of bolt head 5 is not hampered by the integrated ejector 7.

Although certain exemplary apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A firearm which is capable of selectively ejecting a spent cartridge in either a first direction or a second direction comprising:

a bolt carrier defining a first hole and a second hole;

a bolt head mounted to the bolt carrier;

a pin sized to engage the bolt head and the first hole to secure the bolt head in a first position relative to the bolt carrier and to engage the bolt head and the second hole to secure the bolt head in a second position relative to the bolt carrier, wherein the firearm is adapted to eject the spent cartridge in the first direction when the bolt head is in the first position and to eject the spent cartridge in the second direction when the bolt head is in the second position.

2. A firearm as defined in claim 1 further comprising an extractor carried by the bolt head for withdrawing a cartridge casing from a barrel of the firearm during proximal movement of the bolt head.

3. A firearm as defined in claim 2 further comprising an ejector carried by the bolt head and adapted to separate the cartridge casing from the extractor after the casing has been withdrawn from the barrel.

4. A firearm as defined in claim 1 wherein the first hole and the second hole are substantially diametrically opposed.

5. A firearm which is capable of selectively ejecting a spent cartridge in either a first direction or a second direction comprising:

a bolt carrier defining a first hole and a second hole;

a bolt head dimensioned to be at least partially received within the bolt carrier;

a first pin sized to engage the bolt head and the first hole to secure the bolt head in a first position relative to the bolt carrier; and a second pin sized to engage the bolt head and the second hole to secure the bolt head in a second position relative to the bolt carrier, wherein the firearm is adapted to eject the spent cartridge in the first direction when the bolt head is in the first position and to eject the spent cartridge in the second direction when the bolt head is in the second position.

* * * * *